US006024005A

United States Patent [19]

Uozumi

[11] Patent Number: 6,024,005

[45] Date of Patent: Feb. 15, 2000

[54] FORMATION STABILIZING GUIDE FOR BRAIDER

[75] Inventor: Tadashi Uozumi, Kyoto, Japan

[73] Assignee: Murata Kikai Kabushiki Kaisha, Kyoto, Japan

[21] Appl. No.: 09/143,785

[22] Filed: Aug. 31, 1998

[30] Foreign Application Priority Data

Sep. 9, 1997 [JP] Japan ..... 9-262811
Jun. 5, 1998 [JP] Japan ..... 10-157968

[51] Int. Cl.[7] ..... D04C 3/48

[52] U.S. Cl. ..... 87/34; 87/29; 87/33

[58] Field of Search ..... 87/33, 34, 35, 87/14, 44, 48, 62, 28, 29, 31, 43, 61; 57/352, 354, 356

[56] References Cited

U.S. PATENT DOCUMENTS

| | | | |
|---|---|---|---|
| 1,830,196 | 11/1931 | Faure-Roux | 87/6 |
| 2,197,111 | 3/1940 | Muller | 96/3 |
| 3,586,058 | 6/1971 | Ahrens | 138/103 |
| 3,701,247 | 10/1972 | Rehn et al. | 57/352 |
| 3,783,736 | 1/1974 | Richardson | 87/6 |
| 4,471,917 | 9/1984 | Whisnant | 57/354 |
| 4,494,436 | 1/1985 | Kruesi | 87/23 |
| 4,753,149 | 6/1988 | Celani | 87/29 |
| 4,984,502 | 1/1991 | Spain et al. | 87/8 |
| 5,203,249 | 4/1993 | Adams et al. | 87/34 |
| 5,361,674 | 11/1994 | Akiyama et al. | 87/9 |
| 5,417,138 | 5/1995 | Morris et al. | 87/31 |
| 5,476,027 | 12/1995 | Uchida et al. | 87/29 |
| 5,615,453 | 4/1997 | Leifeld | 19/288 |
| 5,815,890 | 10/1998 | Leifeld | 19/288 |

FOREIGN PATENT DOCUMENTS 8-113855 5/1996 Japan .

*Primary Examiner*—John J. Calvert
*Assistant Examiner*—Tejash Patel
*Attorney, Agent, or Firm*—Armstrong, Westerman, Hattori, McLeland and Naughton

[57] ABSTRACT

To enable a braid to be formed with high precision by continuously stabilizing the position of a braid formation point regardless of the shape of a mandrel. A plurality of yarns delivered between a bobbin carrier and a mandrel m cross each other and are intertwined around the mandrel, and the yarns are mounted to a braider so as to form a braid on the mandrel. A formation stabilizing guide for a braider comprises a ring 1 disposed in front of a turning face of the yarns in the formation direction of the braid and passed through by means of the mandrel and a support member 2 which is mounted on the braider body and supports the ring 1 flexibly in a plane perpendicular to the direction of braid formation.

10 Claims, 7 Drawing Sheets

FORMATION STABILIZING GUIDE FOR BRAIDER

FIELD OF THE INVENTION

The present invention relates to a formation stabilizing guide for a braider for forming a variety of braids by braiding a plurality of yarns or fiber bundles (hereinafter referred to as "yarn"). In particular, the present invention relates to a formation stabilizing guide for stabilizing the formation point in the braider.

BACKGROUND OF THE INVENTION

In a conventional braider, as disclosed in Japanese Patent Application Laid-Open No.Hei6-294057, a mandrel is moved in the direction in which braids are formed, each of bobbin carriers meanders along a given track, and a plurality of yarns delivered between each bobbin carrier and the mandrel cross each other and are intertwined around the mandrel, thereby forming the braid on the mandrel.

The braider is provided with a formation stabilizing guide in front of the formation direction of the braid from a turning face of the yarn. A yarn guide ring of the formation stabilizing guide has an inner diameter corresponding to the shape of the braid to be formed, and is disposed with the ring fixed to the braider so as to be substantially parallel to the turning face of the yarn. When a braid is formed, the mandrel is moved in the formation direction of the braid while it is passed through the yarn guide ring. At the same time, a plurality of yarns are supplied from each bobbin carrier, through the yarn guide ring, to formation direction of the braid on the mandrel.

At this time, the swaying of the yarn due to the movement of the bobbin carriers, which meander along the given track, and the variation of the formation point on the mandrel, due to movement of the mandrel are restrained by the action of the yarn guide ring. As a result, the yarns to be formed cross each other regularly in the vicinity of the formation point, thereby enabling stable, uniform formation. In addition, the braids have a symmetric structure and are capable of producing a braid having proper mechanical performance.

A conventional formation stabilizing guide whose position is fixed cannot follow the mandrel's movement in a plane orthogonal to the formation direction of the braid because the guide locks the yarn guide ring in position. Such a configuration requires precise positioning between the mandrel and the guide ring. If the relative position of both the mandrel and the guide ring changes, the braid is formed imprecisely because the formation point cannot be stabilized.

In addition, an adequate action of the yarn guide ring can be achieved by disposing the mandrel so that the axis of the mandrel is nearly perpendicular to the circumference of the yarn guide ring. However, if a braid is formed using a U-shaped mandrel, transversal U-shaped mandrel, or the like, it cannot be disposed in an optimal state because the structure of the braider is restricted. For example, a braid is sometimes formed under conditions where the axis of the mandrel is diagonal to the yarn guide ring. FIG. 10 shows this configuration. In FIG. 10, m is the mandrel, G is a conventional formation stabilizing guide provided with a fixed yarn guide ring 01, Y is a yarn and C is a bobbin carrier. In this case, the formation point of the braid is not stable in the circumferential direction of the mandrel m, thereby disabling forming at a certain formation angle, and the braid thus formed has lower mechanical performance because the braid has a symmetrical structure.

SUMMARY OF THE INVENTION

It is an object of the present invention to provide a formation stabilizing guide capable of following mandrel movement in a plane perpendicular to the formation direction of the braid, thereby stabilizing the position where the braid is formed and achieving a precise braid formation. It is another object of the present invention to provide a means for manufacturing a braid wherein the formation point is stabilized in the circumferential direction of the mandrel even if the orientation of the axle of the mandrel changes during braider actuation. This manufacturing means thereby maintains a constant formation angle, and provides a braid that has a uniform, symmetrical structure and sound mechanical perforce.

To solve the above problems, according to the present invention, there is provided a formation stabilizing guide comprising a yarn guide ring through which a mandrel passes and a support member for supporting this yarn guide ring, said yarn guide ring being flexibly supported by the support member. The support member may support a yarn guide ring in a plane orthogonal to the mandrel's direction of movement. The support member is provided with a balancer for balancing the weight of the yarn guide ring, and the yarn guide ring may be replaced according to the inner diameter required. In addition, the support member may change the orientation of the yarn guide ring so that said yarn guide ring is nearly perpendicular to the axis of the mandrel. There may be provided an actuator that moves the yarn guide ring in conformity with mandrel's movement. This actuator is provided with at least three guide rods that are integrally provided at the yarn guide ring and that protrude in the direction of mandrel movement. A follower may also be provided at the tip end of the guide rods. The follower may remains in contact with the mandrel's outer circumference such that the orientation of the yarn guide ring follows the mandrel's movement.

DETAILED DESCRIPTION OF THE PREFERRED EMBODIMENTS

Hereinafter, preferred embodiments of the present invention will be described with reference to the accompanying drawings.

Figure 1:
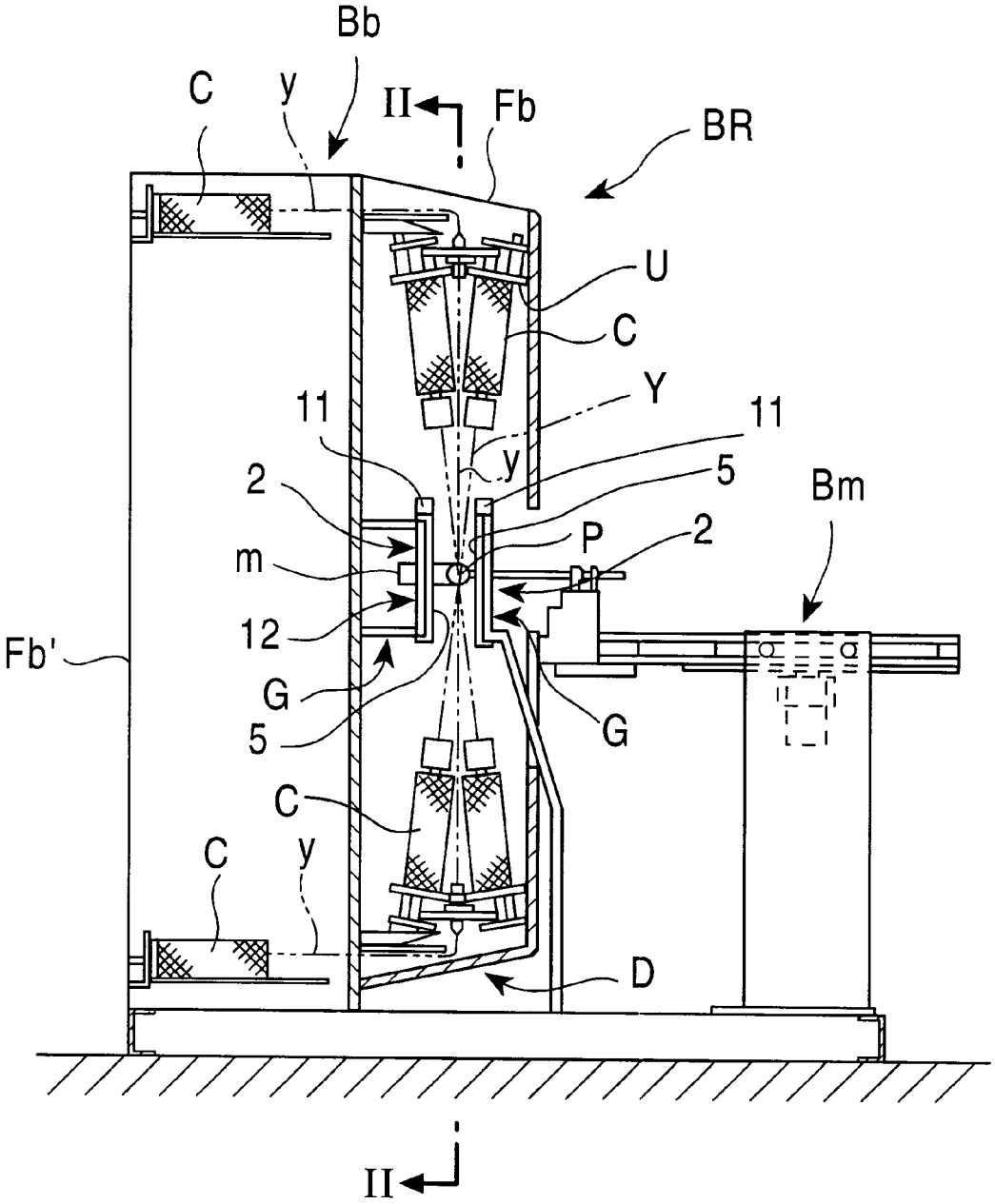
FIG. 1 is a transversal sectional view of a braider comprising a formation stabilizing guide according to the first embodiment.
Figure 2:
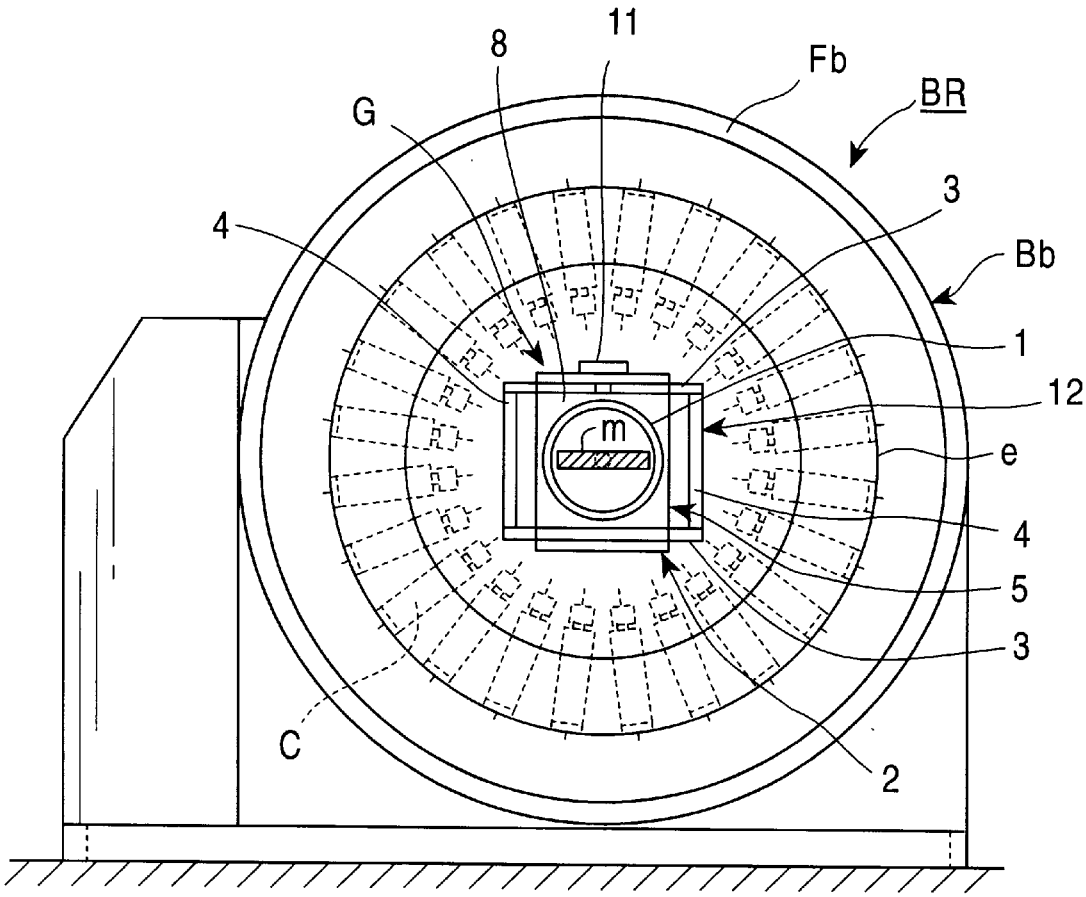
FIG. 2 is a sectional view taken along line II—II of FIG. 1.

FIG. 1 is a transversal sectional view of a braider wherein a braider formation stabilizing guide is used in accordance with the present invention. FIG. 2 is a sectional view taken along line II—II of FIG. 1.

In FIGS. 1 and 2, a braider BR comprises a braider body Bb and a mandrel device Bm.

The braider body Bb has a curved upper plate U having its radius of curvature disposed in a nearly cylindrical machine base Fb having a horizontal axis and an opening e on one side, a bobbin carrier C running along a track disposed in the circumferential direction of the upper plate U and a driving device D for running the bobbin carrier C along the track.

A yarn Y which is drawn out in the direction of the axis of the bobbin from a bobbin loaded on the bobbin carrier C, is installed near the center of the upper plate U. In addition, the position of the mandrel m mounted to the mandrel device Bm is such that the formation point P of the braid formed on the mandrel m is at the center of the upper plate U. The mandrel device Bm can control the position of the mandrel m in one, two, or three dimensions.

Thus, the driving device D drives the bobbin carrier C along the track, and the position of the mandrel m is controlled by means of the mandrel device Bm. As a result, a number of yarns Y delivered between the bobbin carrier C and the mandrel m cross each other and are intertwined around the mandrel m. As required, a central yarn y from the bobbin carrier C which is disposed nearly horizontal to a frame Fb' of a machine base Fb, crosses the yarn Y wound back and assembled from the bobbin carrier C, which runs along the track. In this way, braiding is performed, and a braid is formed on the mandrel m. After braiding has been completed, the yarns Y and y are cut by an appropriate cutting device, and the mandrel m in which the braid is formed is removed from the mandrel device Bm.

A formation stabilizing guide G according to the present invention is disposed in front of the turning face of the yarn Y in the formation direction of the braid. In this embodiment, since the braider BR forms the braid by causing the mandrel m to move forward and backward with respect to the braider BR (i.e., the formation direction of the braid moves forward and backward), a pair of formation stabilizing guides G are disposed in front and in back of the swivel face of the yarn Y, which is sandwiched in the formation direction of the braid. However, in the case of the braider BR that forms the braid by moving the mandrel m with respect to the braider BR (i.e., the formation direction of the braid is always constant), only one formation stabilizing guide G may be disposed in front of the turning face of the yarn Y in the formation direction of the braid.

Each of the formation stabilizing guides G comprises a ring 1, through which the mandrel m can be passed and a support member 2 that is mounted to the braider body Bb and flexibly supports the ring 1 in a plane orthogonal to the formation direction of the braid. In this embodiment, because the formation direction of the braid is essentially horizontal, the ring 1 is flexibly supported in a nearly vertical plane by means of the support member 2.

Figure 3:
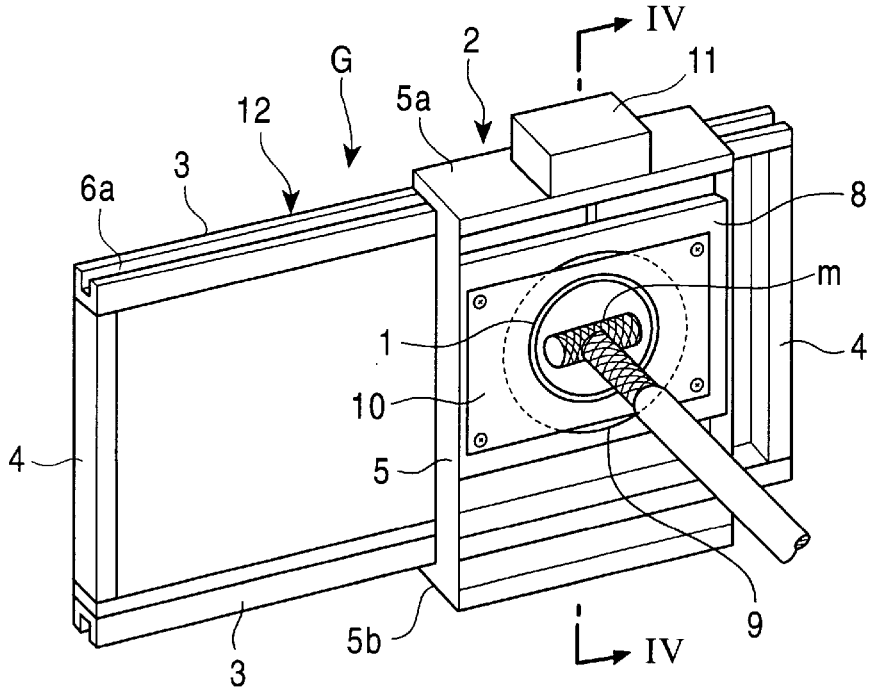
FIG. 3 is a perspective view of the formation stabilizing guide according to the present invention.
Figure 4:
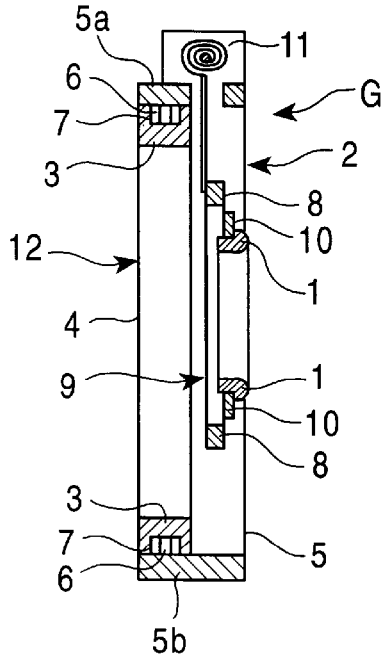
FIG. 4 is a sectional view taken along line IV—IV of FIG. 3.

FIG. 3 is a perspective view of a formation stabilizing guide G according to the present invention. FIG. 4 is a sectional view taken along line IV—IV of FIG. 3. As shown in FIG. 3, the formation stabilizing guide G according to the present invention comprises the ring 1, through which the mandrel m can be passed and the support member 2 that is mounted to the braider body Bb and that flexibly supports the ring 1 in a plane orthogonal to the formation direction of the braid.

The support member 2 has two parallel guide rails 3, 3 disposed vertically, a rectangular frame 12 comprising link members 4, 4 linking these guide rails 3, 3 and a slide member 5 that slides along the guide rails 3, 3.

The slide member 5 has a transversal-U sectional face, and a plurality of rollers 6 are mounted on an opposite face of walls 5*a* and 5*b* so as to form two transversal U-shaped legs. Guide grooves 7, 7 are formed on the upper and lower end faces of the frame 12, that is, on the outside face of the guide rails 3, 3. The rollers 6 for the slide member 5 fit into the guide grooves 7, 7 of the guide rails 3, 3, and at the same time there is some play between the guide rails 3, 3 and the walls 5*a* and 5*b* of the slide member 5. Thus, the rollers 6 of the slide member 5 move along the guide grooves 7, 7 of the guide rail 3, 3. As a result, the slide member 5 can slide freely along the guide rails 3, 3.

A portion linking the walls 5*a* and 5*b* of the slide member 5 has a rectangular frame shape, and in this frame an elevation plate 8 is freely disposed in a vertical direction. To guarantee smooth movement of the elevation plate (not shown in the drawings), a plurality of rollers are mounted on both inner faces of the frame in the elevation plate 8, which can roll on the inner face of the related frame in the vertical direction. A circular opening 9 is formed at the center of the elevation plate 8. The diameter of this circular opening 9 should be large enough that a mandrel m having maximum dimensions can pass through with some margin to spare.

A weight balancing member (balancer) 11 is mounted on the upper face of the slide member 5 and the elevation plate 8 is suspended on the balancer 11. The elevation plate 8 is designed to be flexibly oriented in a vertical direction by the action of the balancer 11.

A ring support plate 10 is mounted with screws on the elevation plate 8. At the center of the ring support plate 10 is a circular opening whose diameter corresponds to that of the ring 1, and the ring 1 is engaged and secured in this circular opening. In this case, the opening of the ring 1 overlaps the circular opening 9 of the elevation plate 8. According to dimensions of the mandrel m to be used, a number of ring support plates 10 having different diameter rings 1 should be prepared in advance, and the ring support plates 10 should be replaced as needed. In this case, a structure analogous to a camera collimator is preferable because the diameter of the ring 1 can be changed without replacing the ring support plate 10.

Thus, as shown in FIGS. 1 and 2, a pair of formation stabilizing guides G according to the present invention are disposed in front of and in back of the turning face of the yarn Y, which is being sandwiched in the formation direction of the braid. A frame 12 for the support member 2 of the formation stabilizing guide G is mounted and secured on the body of the braider BR by adequate mounting means. The frame 12 is positioned in a plane that is largely orthogonal to the formation direction of the braid (which is essentially horizontal), and two guide rails 3, 3 are disposed so as to extend horizontally.

In a plane orthogonal to the formation direction of the braid, the slide member 5 slides freely in the horizontal direction along the guide rails 3, 3, the elevation plate 8 having the ring support plate 10 is flexibly oriented in the vertical direction by means of the action of the balancer 11, and thus the ring 1 is flexibly supported in a plane orthogonal to the formation direction of the braid.

Thus, with the formation stabilizing guide G according to the present invention, the meandering yarn Y due to transversal movement of the bobbin carrier running while swaying along the track disposed at the upper plate U is guided, and the formation point P can be mounted at a substantially constant position by restraining that meandering. As a result, yarns Y to be formed cross each other uniformly in the vicinity of the formation point P, and stable formation is achieved.

Further, with the formation stabilizing guide G according to the present invention, the ring 1 is flexibly supported in a plane orthogonal to the formation direction of the braid so as to easily follow the movement of the mandrel m. Therefore, there is no need for precise alignment when the formation stabilizing guide G is mounted to the braider BR. Even when forming a braid using a bent-shaped mandrel m, the ring 1 follows the movement of the mandrel m in a plane orthogonal to the formation direction of the braid such that the angle at which the mandrel m passes through the ring 1 is not restrained. Thus, the position of the formation point P can be always stabilized, and the braid can be formed precisely.

Figure 5:
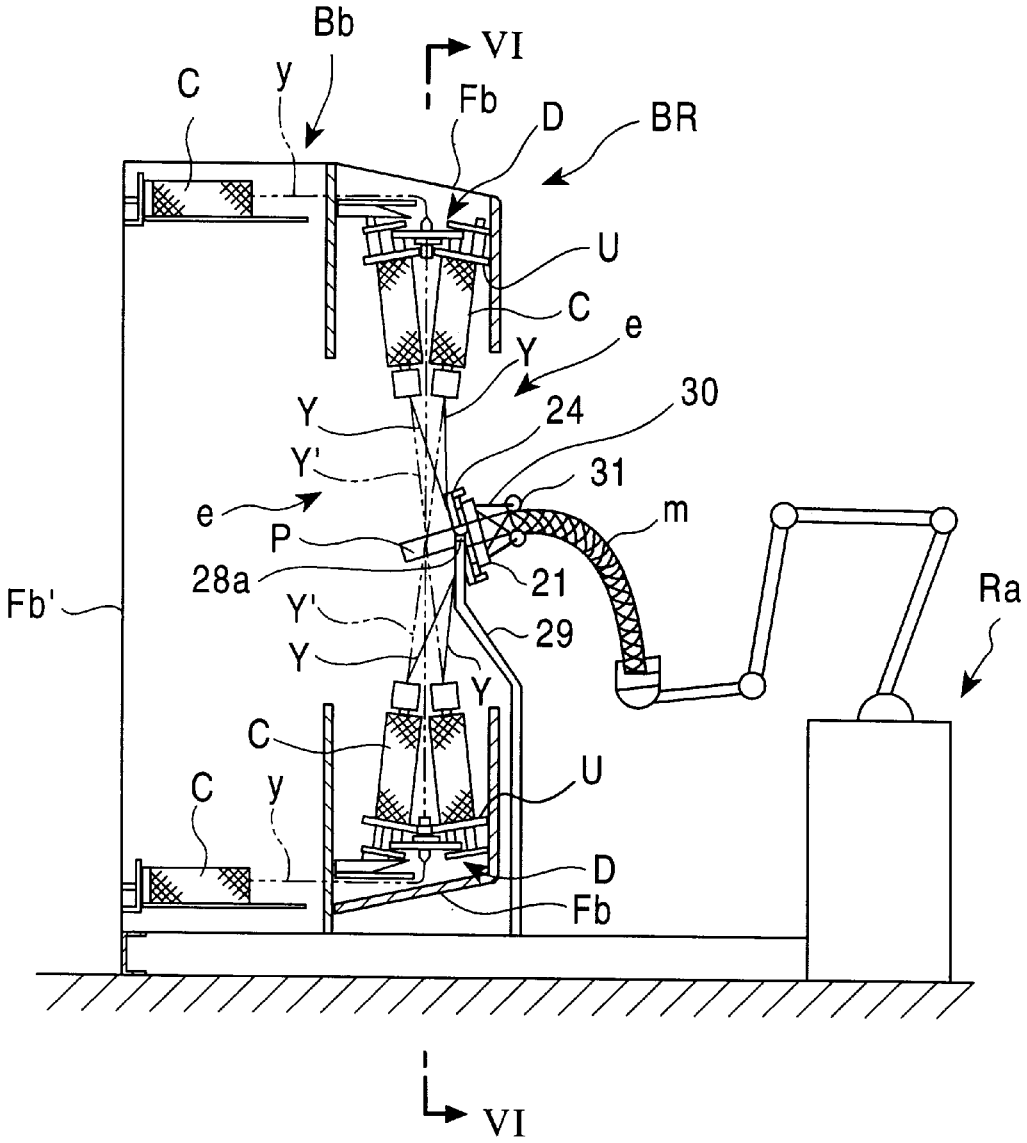
FIG. 5 is a sectional view of a braider comprising a formation stabilizing guide according to the second embodiment.
Figure 6:
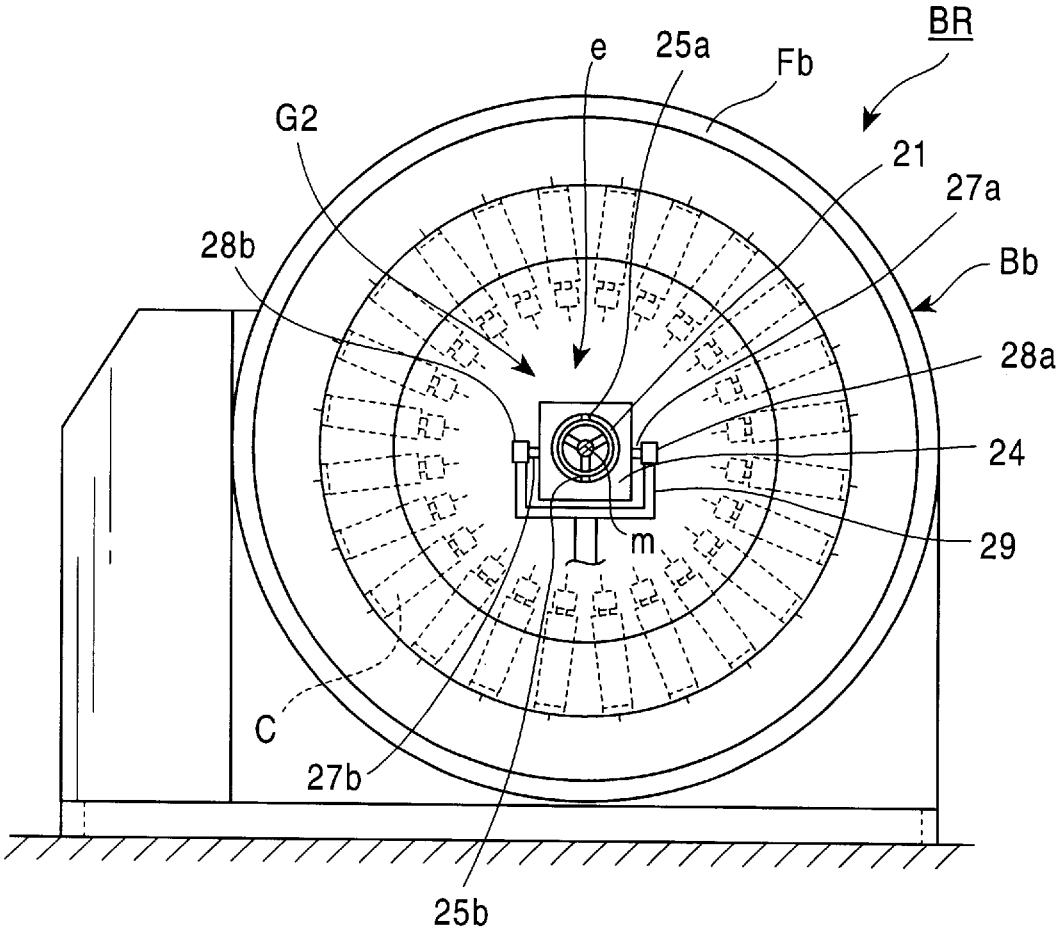
FIG. 6 is a sectional view taken along line VI—VI of FIG. 5.

Now, a formation stabilizing guide according to a second embodiment of the present invention will be described with reference to FIGS. 5 to 10. In FIGS. 5 and 6, the braider BR comprises the braider body Bb and a robot arm device Ra.

The braider body Bb has a curved upper plate U having a certain radius of curvature disposed in a substantial cylindrical machine base Fb having a horizontal axis and an opening e at both ends, a plurality of bobbin carriers C running along a track (not shown in the drawings) disposed in the circumference direction of the upper plate U, and a driving device D for running the bobbin carriers C along the track.

When the mandrel m is not moved in the formation direction of the braid, the yarns (refer to the dashed line Y' in FIG. 5) to be drawn out from the bobbins which are loaded on each bobbin carrier C, parallel to the axis of the bobbins are collected near the center of the upper plate U. With respect to the position of the mandrel m mounted to the robot arm device Ra, the formation point P to be formed on the mandrel m is positioned at the center of the upper plate U. The robot arm device Ra can control the position of the mandrel m in one, two, or three dimensions.

Thus, the driving device D drives each bobbin carrier C along the track, and the robot arm device Ra moves the mandrel m in the formation direction of the braid. Thereby, a number of yarns Y delivered between each bobbin carrier C and the mandrel m cross each other and are intertwined around the mandrel m. As required, the central yarn y from the bobbin carrier C disposed largely horizontally to the frame Fb' of a machine base Fb crosses the yarn that is rewind and assembled from the bobbin carrier C running along the track. In this way, a braid is formed on the mandrel m. When braiding is completed, yarns Y and you are cut by means of an appropriate cutting device, and the mandrel m in which the braid is formed is removed from the robot arm device Ra.

The formation stabilizing guide G2 according to the second embodiment is disposed in front of the turning face of a yarn Y in the formation direction of the braid. In this embodiment, since the braider BR forms a braid by moving the mandrel m uni-directionally with respect to the braider BR (that is, the formation direction of the braid is always constant), only one formation stabilizing guide G2 is disposed in front of the turning face of the yarn Y in the formation direction of the braid. In the case, where braider BR forms a braid by moving the mandrel m forward and backward with respect to the braider BR, a pair of formation stabilizing guides G2 according to the present invention are disposed in front of and in back of the turning face of the yarn Y, whichis sandwiched in the formation direction of the braid.

Figure 7:
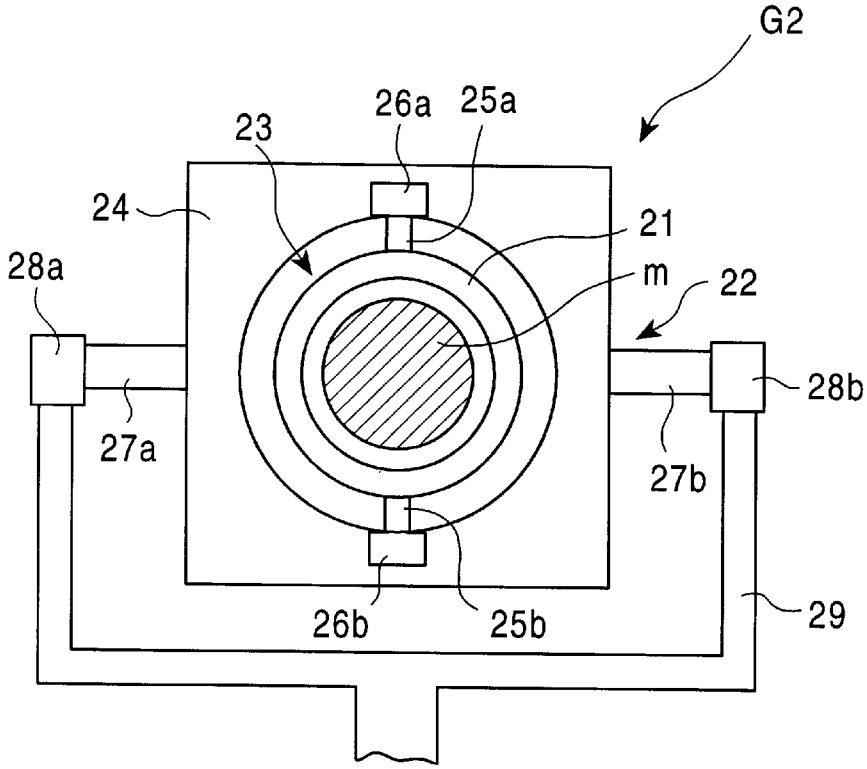
FIG. 7 is a frontal view of a formation stabilizing guide according to the second embodiment.
Figure 8:
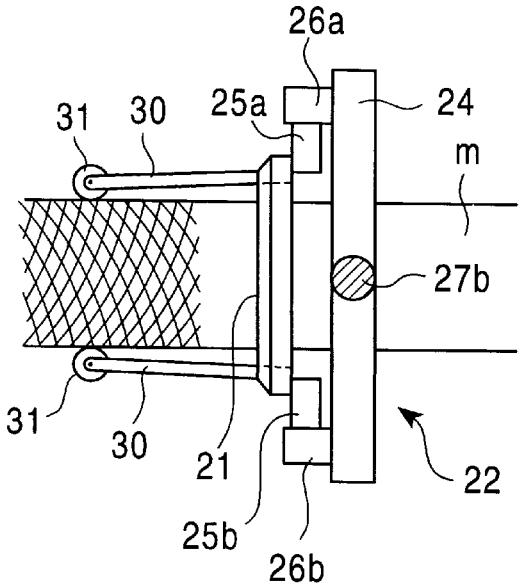
FIG. 8 is a side view of the formation stabilizing guide of FIG. 7.

FIGS. 7 and 8 are, respectively, a front view and a side view of the formation stabilizing guide G2 according to the second embodiment. As shown in FIGS. 7 and 8, the formation stabilizing guide G2 comprises a yarn guide ring 21, through which the mandrel m passes, and a support member 22 that is mounted to the braider body Bb and that supports the yarn guide ring 21.

As can be seen in FIG. 7, the support member 22 has a rectangular support plate 24 with a circular opening 23 that is greater than the diameter of the yarn guide ring 21. The yarn guide ring 21 is concentrically disposed within the circular opening 23 of the support plate 24. The yarn guide ring 21 is provided with rotary shafts 25*a*, 25*b* extending outside of the yarn guide ring 21 in the direction of one diameter (parallel to a side edge of the support plate 24 in the embodiment shown in FIG. 7) and the rotary shafts 25*a*, 25*b* each are supported by bearings 26*a*, 26*b* provided on the support plate 24. That is, the yarn guide ring 21 is oriented and supported 360 degrees around the rotary shafts 25*a*, 25*b* by means of a support plate 24.

As shown in FIG. 7, at the side edge of the support plate 24 are provided rotary shafts 27*a*, 27*b* facing the center of the circular opening 23 and extending to the outside of the support plate 24 along a direction orthogonal to the rotary shafts 25*a*, 25*b*. Further, the rotary shafts 27*a*, 27*b* are supported by bearings 28*a*, 28*b* provided at the tip end of the support frame 29 which is formed in an essentially U shape. That is, the support plate 24 is oriented and supported 360 degrees around the rotary shafts 27*a*, 27*b* between the U-shaped legs of the tip end of the support frame 29.

In the second embodiment, the support member 22 which supports the yarn guide ring 21 comprises a support plate 24, rotary shafts 25*a*, 25*b*, bearings 26*a*, 26*b*, rotary shafts 27*a*, 27*b*, bearings 28*a*, 28*b* and a support frame 29. The support frame 29 is mounted and secured to the braider body Bb such that the braid is disposed in front of the formation direction of the braid from the turning face of the yarn Y.

As shown in FIG. 8, at least three guide rods 30 are integrally provided at the yarn guide ring 21 such that they protrude from the yarn guide ring 21 in the formation direction of the braid. These guide rods 30 have rollers 31 (followers) at their tip ends, the rollers 31 contact the outer circumference of the mandrel m and roll over the outer circumference of the mandrel m due to the movement of the mandrel m.

Thus, the yarn guide ring 21 is positioned by means of the guide rods 30 and the roller 31 so that its surrounding face is essentially perpendicular to the axis of the mandrel m.

Since the yarn guide ring 21 can rotate independently and freely around axes orthogonal to each other and orthogonal to the axis of the mandrel m, even if an orientation of the axis of the mandrel m changes while the braider BR is actuated and a braid is formed, the yarn guide ring 21 can move freely in conformity with movement of the mandrel m so that its surrounding face is essentially perpendicular to the axis of the mandrel m. The guide rods 30 and the roller 31 function as an actuator that moves the yarn guide ring 21 in conformity with the movement of the mandrel m.

Figure 9:
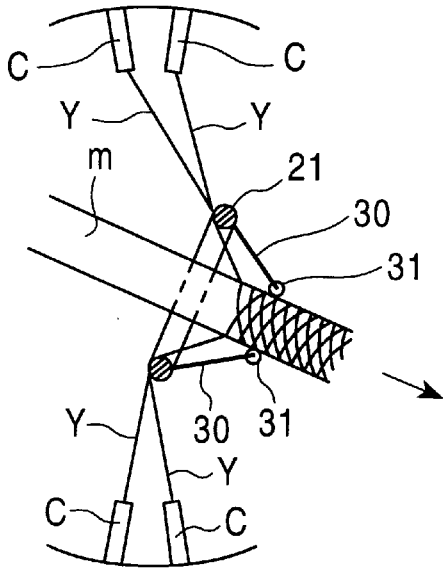
FIG. 9 is a schematic side view showing the positional relationship between a yarn guide ring and a mandrel when a braid is formed in a braider comprising a formation stabilizing guide according to the second embodiment.
Figure 10:
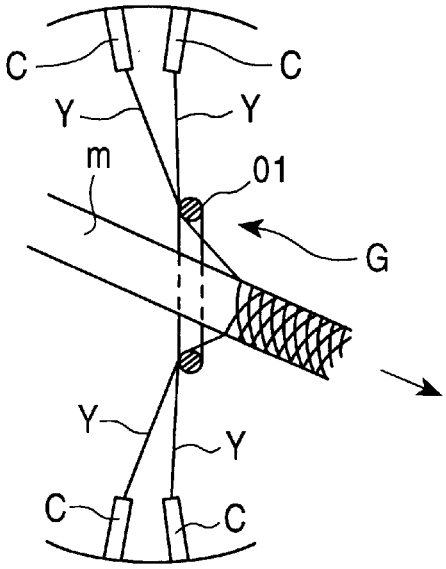
FIG. 10 is a schematic side view showing the positional relationship between a yarn guide ring and a mandrel when a braid is formed by a conventional braider.

Therefore, when the braider BR is actuated, the mandrel m moves in the formation direction of the braid while passing through the yarn guide ring 21 of the formation stabilizing guide G2. Then, a plurality of yarns Y are supplied to the formation point on the mandrel m from each bobbin carrier C through the yarn guide ring 21. Further, a plurality of yarns Y delivered between each bobbin carrier C and the mandrel m cross each other and are intertwined around the mandrel, and thus a braid is formed on the mandrel m. Even if the mandrel m's axis changes its orientation while forming the braid, the yarn guide ring 21 moves in conformity with movement of the mandrel m so that its surrounding face is always essentially perpendicular to the axis of the mandrel m. This situation is shown in FIG. 9. Even if the orientation of the axis of the mandrel m changes, the position of the formation point is stabilized with respect to the circumferential direction of the mandrel m, the angle of braid formation remains constant, and a braid having a uniform structure and good mechanical perforce can be produced.

In the second embodiment, the yarn guide ring 21 is positioned with respect to the mandrel m by using the guide rods 30 and the guide rollers 31 (followers) such that the yarn guide ring 21 follows changes in the orientation of the axis of the mandrel m, however, the present invention is not limited to the configuration shown in this embodiment. For example, the present invention can be configured such that one of the rotary shafts 25*a*, 25*b* is rotated by a motor, and one of the rotary shafts 27*a*, 27*b* is rotated by another motor. By controlling the rotations of these two motors, the yarn guide ring 21 can be moved to accommodate changes in the orientation of the axis of the mandrel m such that its surrounding face is always substantially perpendicular to the axis of the mandrel m. In this case, the guide rods 30 and the guide rollers 31 are not necessary.

According to the present invention, high precision braid formation can be achieved by continuously stabilizing the formation point. In the case where the yarn guide ring through which the mandrel passes follows mandrel movement during braider formation so that the surrounding face of the yarn guide ring is always perpendicular to the axle of the mandrel, the position of the formation point is stabilized with respect to the circumferential direction of the mandrel, and the braid formation angle can be kept constant. This makes it possible to manufacture a braid having a uniform structure and good mechanical performance.

I claim:

1. A formation stabilizing guide for a braider comprising a yarn guide ring having an opening for passing a mandrel through said opening, and a supporting member that supports said yarn guide ring so that said yarn guide ring can freely move relative to said supporting member between at least two different positions of said yarn guide ring.

2. A formation stabilizing guide for a braider as claimed in claim 1, wherein said yarn guide ring can freely move in at least one direction in a main plane of said varn guide ring.

3. A formation stabilizing guide for a braider as claimed in claim 1, wherein said two different positions are in planes having different orientations.

4. A formation stabilizing guide for a braider as claimed in claim 3, further comprising an actuator arranged to move said yarn guide ring in conformity with the movement of the mandrel.

5. A formation stabilizing guide for a braider as claimed in claim 1, wherein said support member is provided with a balancer for balancing the weight of said yarn guide ring.

6. A formation stabilizing guide for a braider as claimed in claim 5, wherein said yarn guide ring can freely move in at least one direction in a main plane of said yarn guide ring.

7. A formation stabilizing guide for a braider comprising a yarn guide ring having an opening for passing a mandrel through said opening and a supporting member that supports said yarn guide ring so that said yam guide ring can freely move relative to said supporting member between at least two different positions of said yarn guide ring, wherein said two positions are in planes having different orientations, and an actuator is arranged to move said yarn guide ring in conformity with the movement of said mandrel, said actuator comprising at least three guide rods integrally provided on said yarn guide ring, said guide rods being arranged to protrude in a direction of movement of the mandrel, a follower being provided at the tip end of said guide rods, said follower being arranged to be in contact with the outer circumference of the mandrel, so that the orientation of said yarn guide is adapted in conformity with the movement of the mandrel.

8. A formation stabilizing guide for a braider comprising a yarn guide ring having an opening for passing a mandrel through said opening, and a supporting member that supports said yarn guide ring so that said yarn guide ring can freely move relative to said supporting member between at least two different positions of said yarn guide ring, wherein said yarn guide ring is detachably supported by said support member, so that said yarn guide ring can be replaced by another yarn guide ring having a different inner diameter.

9. A formation stabilizing guide for a braider as claimed in claim 8, wherein said yarn guide ring can freely move in at least one direction in a main plane of said yarn guide ring.

10. A formation stabilizing guide for a braider as claimed in claim 8, wherein said support member is provided with a balancer for balancing the weight of said yam guide ring.

* * * * *